US008959712B2

(12) United States Patent
Rawdin

(10) Patent No.: US 8,959,712 B2
(45) Date of Patent: Feb. 24, 2015

(54) DOOR ARRESTER FOR VEHICLE DOORS OF MOTOR VEHICLES

(71) Applicant: Ford Global Technologies, LLC, Dearborn, MI (US)

(72) Inventor: Andrej Rawdin, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/281,090

(22) Filed: May 19, 2014

(65) Prior Publication Data

US 2014/0359975 A1 Dec. 11, 2014

(30) Foreign Application Priority Data

Jun. 5, 2013 (DE) ..... 10 2013 210 442

(51) Int. Cl.
*E05F 5/06* (2006.01)
*E05D 11/10* (2006.01)

(52) U.S. Cl.
CPC ..... *E05D 11/1028* (2013.01)
USPC ..... 16/85

(58) Field of Classification Search
USPC ..... 16/75, 85, 337, DIG. 10, DIG. 17, 16/DIG. 21
See application file for complete search history.

(56) References Cited

U.S. PATENT DOCUMENTS 5,474,344 A * 12/1995 Lee ..... 292/262
7,240,399 B2 * 7/2007 Murayama et al. ..... 16/82
7,383,614 B2 * 6/2008 Matsuki ..... 16/86 B
7,870,641 B2 * 1/2011 Hoffmann et al. ..... 16/82
8,429,793 B2 * 4/2013 Heinrichs et al. ..... 16/86 B
2003/0101537 A1 * 6/2003 Matsuki et al. ..... 16/85
2004/0251696 A1 12/2004 Murayama et al.
2006/0059657 A1 * 3/2006 Heinrichs et al. ..... 16/85
2006/0207058 A1 * 9/2006 Heinrichs et al. ..... 16/86 B
2007/0040392 A1 * 2/2007 Matsuki ..... 292/262
2008/0184525 A1 * 8/2008 Cruz et al. ..... 16/85
2008/0209675 A1 * 9/2008 Sempert et al. ..... 16/85
2010/0154163 A1 * 6/2010 Hoffmann ..... 16/85

FOREIGN PATENT DOCUMENTS

DE 19800678 A1 7/1999
DE 10251174 A1 5/2004
EP 0959210 A1 11/1999
EP 1951977 B1 4/2009
WO 2013057916 A1 4/2013

* cited by examiner

*Primary Examiner* — Roberta Delisle
(74) *Attorney, Agent, or Firm* — Raymond Coppiellie; Price Heneveld LLP

(57) ABSTRACT

A door arrester for vehicle doors of motor vehicles, comprising a retaining part for fastening to a door or door pillar and a housing. A door retaining bar passes through a through-opening in the housing in a longitudinally displaceable manner. The door retaining bar is pivotably fastened to the door or door pillar and has a contact surface which comprises at least one first contact portion and at least one ramp-shaped second contact portion. At least one retaining body is pretensioned in the direction of the door retaining bar by a spring element and guided in the housing. The retaining body comprises at least two contact elements, wherein the contact elements have different coefficients of friction relative to the operative connection with the contact surface of the door retaining bar.

13 Claims, 1 Drawing Sheet

DOOR ARRESTER FOR VEHICLE DOORS OF MOTOR VEHICLES

FIELD OF THE INVENTION

The present invention generally relates to a door arrester for vehicle doors of motor vehicles.

BACKGROUND OF THE INVENTION

DE 102 51 174 B4 discloses a door arrester for a vehicle door of a motor vehicle. The door arrester has a retaining part with a housing which is able to be fastened, for example, to a door of the motor vehicle, a door retaining bar which passes through a through-opening in the housing in a longitudinally displaceable manner and which is able to be fastened in a pivotable manner, for example, to a door pillar of the motor vehicle and two retaining bodies guided in the housing which in each case are pretensioned by means of a compression spring in the direction of the door retaining bar and are operatively connected therewith via a friction surface formed on the retaining body. The door retaining bar has latching recesses in which the retaining body can slide with a longitudinal displacement of the door retaining bar, and is thus able to secure the vehicle door in the latching recesses.

A door arrester for vehicle doors of motor vehicles is also disclosed in EP 0 959 210 A1, in which a first retaining body which is pretensioned by means of a compression spring in the direction of a door retaining bar has a friction surface which bears against the door retaining bar and slides thereon with a longitudinal displacement of the door retaining bar. A second retaining body which is also pretensioned by means of a compression spring in the direction of the door retaining bar has a roller made of metal or plastics material which with a longitudinal displacement of the door retaining bar rolls thereon.

A further door arrester for vehicle doors of motor vehicles is disclosed in EP 1 951 977 B1. The door arrester has only one retaining body which is pretensioned by means of a compression spring and which in a first embodiment comprises a friction surface via which it slides on a longitudinally displaceable door retaining bar with a longitudinal displacement thereof. In a second embodiment, the retaining body has a rolling bearing via which the retaining body with a longitudinal displacement of the door retaining bar rolls thereon. The door retaining bar has no latching recesses so that the vehicle door is able to be retained in any position.

It is generally desirable to provide door arresters for vehicle doors of motor vehicles with a relatively high retaining force in order to be able to hold the vehicle door securely during opening and closing procedures, even between the latching positions of the door arrester predetermined by the latching recesses of the door retaining bar. On the other hand, high retaining forces which are substantially applied via the retaining bodies pretensioned by means of the compression spring in the direction of the door retaining bar, however, have the effect that during opening and closing movements the latching recesses of the door retaining bar are only able to be overcome by a relatively high expenditure of force, as out of each latching recess the compression springs have to be pretensioned again.

It would be desirable to provide a door arrester for vehicle doors of motor vehicles which, on the one hand, has a high retaining force for retaining the vehicle door during opening and closing procedures between the latching positions of the door arrester predetermined by the latching recesses of the door retaining bar and, on the other hand, requires a relatively small expenditure of force for overcoming the latching positions of the door arrester.

SUMMARY OF THE INVENTION

According to one aspect of the invention, a door arrester for vehicle doors of motor vehicles comprises a retaining part which comprises a fastener for fastening to a door or door pillar of the motor vehicle and a housing. The door arrester according to this one aspect of the invention further comprises a door retaining bar which passes through a through-opening in the housing in a longitudinally displaceable manner. The door retaining bar further comprises a pivotal fastener for pivotably fastening to the door or door pillar of the motor vehicle. At this point it should be understood that, within the meaning of the present invention, the retaining part and the door retaining bar are not fastened to the same component of the motor vehicle (door or door pillar) but the retaining part may be fastened, for example, to the door and the door retaining bar may be fastened to the door pillar of the motor vehicle or vice versa.

The door retaining bar also has a contact surface which comprises at least one first contact portion extending substantially parallel to a longitudinal axis of the door retaining bar and at least one ramp-shaped second contact portion extending obliquely to the longitudinal axis of the door retaining bar. Two first contact portions extending parallel to the longitudinal axis, which are connected together via a second ramp-shaped contact portion, within the meaning of the present invention form a latching recess or a latching projection according to whether the ramp-shaped second contact portion rises or falls relative to its alignment obliquely to the longitudinal axis of the door retaining bar.

The door arrester according to this aspect the present invention further comprises at least one retaining body pretensioned in the direction of the door retaining bar by a spring element, for example a compression spring or tension spring, and guided in the housing. According to this aspect of the invention, the retaining body comprises at least two contact elements, by longitudinal displacement of the door retaining bar the first contact element thereof being able to be brought into an operative connection with the first contact portion and the second contact element thereof being able to be brought into an operative connection with the second contact portion. The contact elements have different coefficients of friction relative to the operative connection with the contact surface of the door retaining bar.

The door arrester thus permits a specific influence of the frictional forces which, with the longitudinal displacement of the door retaining bar relative to the retaining body, act between the contact elements of the retaining body and the contact surface of the door retaining bar. This permits, for example, an advantageous design of the door arrester such that, in particular, the frictional force which is effective in the second contact portion may be selected to be lower between the second contact element and the contact surface of the door retaining bar than the frictional force which is effective in the first contact portion between the first contact element and the contact surface, whereby a lower force is required for overcoming the second ramp-shaped contact portion and yet a relatively high retaining force may be ensured between the first contact element and the first contact portion.

Accordingly, an advantageous embodiment of the invention provides that the second contact element which is able to be brought into an operative connection with the second contact portion has a substantially lower coefficient of friction than the first contact element which is able to be brought into an operative connection with the first contact portion. Latching recesses and/or latching projections formed from the first and second contact portions may as a result be overcome by a lower force expenditure, but the door arrester according to the invention nevertheless provides a relatively high retaining force in the first contact portions of the contact surface of the door arrester located between the second contact portions.

According to a further advantageous embodiment of the invention, the contact elements are formed from different materials. The materials have correspondingly different coefficients of friction relative to the operative connection with the contact surface of the door retaining bar.

A particularly preferred embodiment of the contact element which is simple to produce may be implemented by a friction surface and at least one contact element is configured as such a friction surface.

In order to increase further the difference in the expenditure of frictional force between the first and second contact elements, a further advantageous embodiment of the invention provides that at least one contact element is configured as a rolling bearing or rolling body which is rotatably mounted on the retaining body. Known rolling bodies generally used in rolling bearings may be used as rolling bodies, such as for example balls, cylinders, barrels, etc.

Further features and advantages of the invention are revealed from the following description of an exemplary embodiment of the invention which is to be understood as non-limiting and which is described in more detail hereinafter with reference to the drawings. It should be noted that the features set forth in detail in the claims may be combined with one another in any technically expedient manner and reveal further embodiments of the invention. The description additionally characterizes and specifies the invention, in particular in combination with the drawings.

These and other aspects, objects, and features of the present invention will be understood and appreciated by those skilled in the art upon studying the following specification, claims, and appended drawings.

DETAILED DESCRIPTION OF THE PREFERRED EMBODIMENTS

While various aspects of the inventive subject matter are described with reference to a particular illustrative embodiment, the inventive subject matter is not limited to such embodiments, and additional modifications, applications, and embodiments may be implemented without departing from the inventive subject matter. In the figures, like reference numbers will be used to illustrate the same components. Those skilled in the art will recognize that the various components set forth herein may be altered without varying from the scope of the inventive subject matter.

Figure 1:
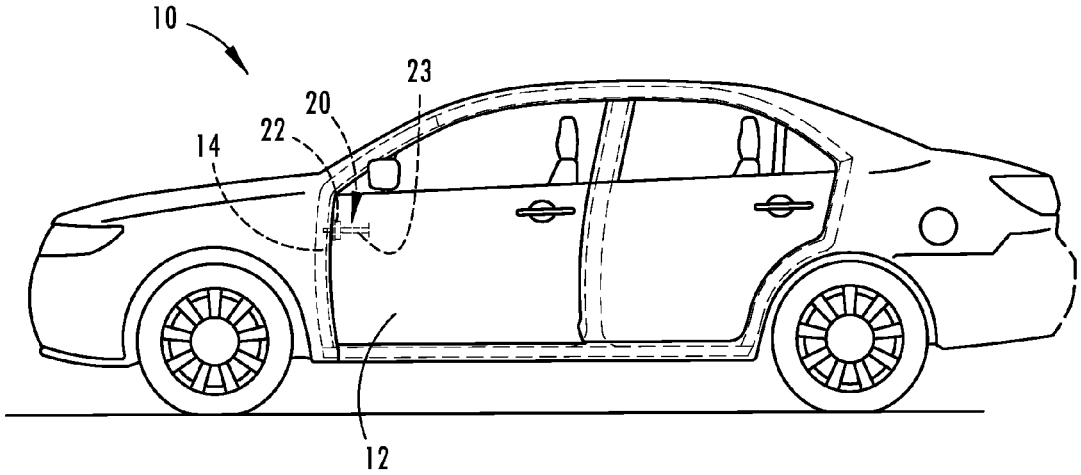
FIG. 1 is a side view of a motor vehicle having a door arrester coupled to a vehicle door, according to one embodiment.
Figure 1A:
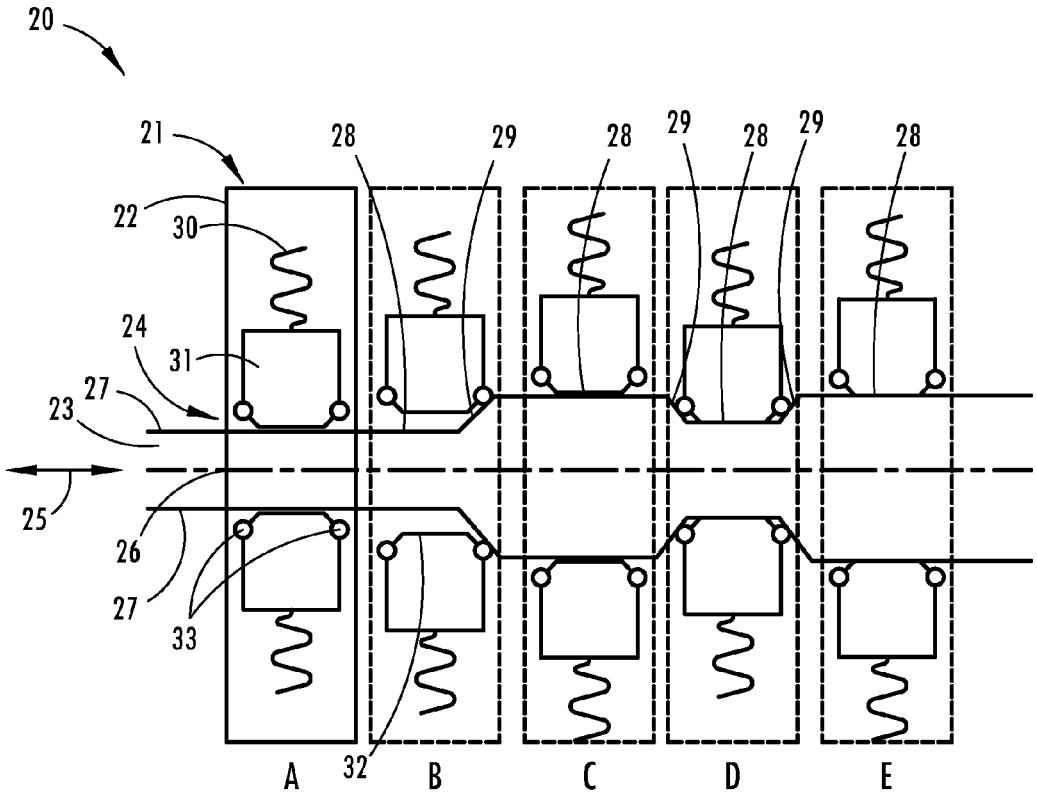
FIG. 1A shows schematically a detail of the door arrester according to one embodiment in a lateral cross-sectional view in operating positions occurring successively during an opening movement of the vehicle door.

Referring to FIGS. 1 and 1A, a door arrester 20 (also referred to as a door check) for a vehicle door 12 of a motor vehicle 10 is generally shown denoted by the reference numeral 20, according to one embodiment. The door arrester 20 comprises a retaining part 21 with a fastener as a means for fastening to a door 12 of the motor vehicle 10 and a housing 22. Also visible in FIG. 1A is a door retaining bar 23 which passes through a through-opening 24 in the housing 22 in a longitudinally displaceable manner, corresponding to the double arrow 25 indicated in FIG. 1A. In the exemplary embodiment shown in FIG. 1A, the door retaining bar 23 also has a pivotal fastener as a means for pivotably fastening to the door pillar 14 (e.g., A-pillar) of the motor vehicle 10. It should be appreciated that each door 12 of motor vehicle 10 may be connected to a door arrester 20. In FIG. 1A, a longitudinal axis 26 of the door retaining bar 23 may also be seen, relative to which the door retaining bar 23 is constructed substantially symmetrically, in particular with regard to an upper and lower contact surface 27 of the door retaining bar 23.

In the exemplary embodiment of the door arrester 20 shown in FIG. 1A, the contact surface 27 of the door retaining bar 23 comprises four first contact portions 28 extending substantially parallel to the longitudinal axis 26 of the door retaining bar 23 and three ramp-shaped second contact portions 29 extending obliquely to the longitudinal axis 26. As may be seen further in FIG. 1A, the ramp-shaped contact portions 29 connect the successive first contact portions 28, in the exemplary embodiment shown, such that viewed from left to right proceeding from a first latching recess (first portion 28), a first latching projection (second portion 28) follows, then a second latching recess (third portion 28), followed by a second latching projection (fourth portion 28. Thus, viewed from left to right, the first ramp 29 is a rising ramp, the second ramp 29 is a falling ramp, finally followed by a ramp 29 rising again.

In the exemplary embodiment shown in FIG. 1A the door arrester 20 comprises two retaining bodies 31 pretensioned in the direction of the door retaining bar 23 by means of a compression spring 30 and guided in the housing 22, so that the retaining bodies 31 on both sides of the door retaining bar 23 bear against the respective upper and/or lower contact surface 27.

In the embodiment shown, the retaining body 31 further comprises a total of three contact elements, namely a first contact element 32 and two second contact elements 33. In the door arrester 20 according to the embodiment shown in FIG. 1A, the first contact element 32 of the retaining body 31 is configured as a friction surface and the two second contact elements 33 are configured as rolling bodies rotatably mounted on the retaining body 31, for example cylinders or balls.

With reference to the five operating positions A to E shown in FIG. 1A of the door arrester 20, shown by way of example, it is now explained how the contact elements 32 and 33 of the retaining body 31 are operatively connected and/or brought into an operative connection with the contact surface 27 of the door retaining bar 23. In the different views of the operating positions A to E, a longitudinal displacement of the door retaining bar 23 from right to left is shown.

In the operating position A, the door retaining bar 23 is located in an initial position. In this position, for example, the vehicle door of the motor vehicle retained by the door arrester 20 is located in a closed position. The retaining body 31 pretensioned by the compression spring 30 in the direction of the door retaining bar 23, bears via the first contact element 32 against the contact surface 27 and, in particular, against the first contact portion 28 of the contact surface 27 and is operatively connected therewith. When opening the vehicle door, the longitudinal displacement of the door retaining bar 23 to the left has the effect of the first contact element 32 sliding along the first contact portion 28. In this case, a specific frictional force has to be overcome which, in addition to the contact force applied by the compression spring 30, also depends on the material properties of the first contact element 32, in particular on the coefficients of friction of the material used relative to the operative connection with the contact surface 27.

As soon as the retaining body 31 reaches the second contact portion 29 of the contact surface 27 (see operating position B) the second contact element 33 is operatively connected to the second contact portion 29 of the contact surface 27 which in turn is determined, in particular, by the coefficients of friction of the second contact element 33 relative to the contact surface 27 of the second contact portion 29. As the second contact elements 33, in the exemplary embodiment shown of the door arrester 20, are configured as rolling bodies rotatably mounted on the retaining body 31, with a further longitudinal displacement of the door retaining bar 23 to the left, only the rolling frictional forces acting between the second contact element 33 and the second contact portion 29 have to be overcome as, due to the rising ramp of the second contact portion 29, in the operating position B, the retaining body 31 together with the first contact element 32 is raised, the first contact element no longer being operatively connected to the contact surface 27. The coefficient of friction of the second contact element 33 in the exemplary embodiment shown is substantially less than the coefficient of friction of the first contact element 32 which is why the rising ramp of the second contact portion 29 in the operating position B may be overcome by a relatively low expenditure of force. Thus, with the second contact portion 29, which is able to be overcome relatively easily, the contact force applied by the compression spring 30 may be selected so that a sufficiently high retaining force is nevertheless produced for secure retention of the vehicle door by the first contact element 32 in each of the first contact portions 28 of the operating positions C, D and E.

As the retaining body 31 has not only one second contact element 33 but two second contact elements 33, the easy "introduction", shown in the operating position D, into the latching recess 28 of the operating position D is assisted by the second contact element 33 in the same manner as has already been described when overcoming the rising ramp 29 in the operating position B.

The door arrester according to one embodiment has been described in more detail with reference to an exemplary embodiment shown in the FIGS. 1 and 1A. The door arrester, however, is not limited to the embodiment described herein but also encompasses in each case further embodiments acting in the same manner. Thus, it is also possible in principle to provide the different contact elements on the door retaining bar instead of on the retaining body. The contact elements would then have to be provided along the contact surface of the door retaining bar, in all locations where a specific influence of the frictional forces between the retaining body and the contact surface of the door retaining bar is desired. For example, the first contact element could be configured in each first contact portion and the second contact element could be configured in each second contact portion. An advantage of this configuration is to be able to influence the frictional forces acting between the retaining body and the contact surface of the door retaining bar, with a longitudinal displacement of the door retaining bar, and also depending on the path covered by the door retaining bar. To this end, more than just two different contact elements could be used with different frictional properties in the respective first and second contact portions of the door retaining bar.

In a preferred embodiment, the door arrester is used in a vehicle, in particular a motor vehicle, for retaining a vehicle door during opening and closing procedures.

It will be appreciated by those skilled in the art that although the invention has been described by way of example with reference to one or more embodiments it is not limited to the disclosed embodiments and that alternative embodiments could be constructed without departing from the scope of the invention as defined by the appended claims.

What is claimed is:

1. A door arrester for a vehicle door of a motor vehicle, comprising a retaining part which comprises a fastener for fastening to a door or door pillar of the motor vehicle and a housing;

a door retaining bar passing through a through-opening in the housing in a longitudinally displaceable manner, said door retaining bar comprising a pivotal fastener for pivotably fastening to the door or door pillar of the motor vehicle and a contact surface which comprises at least one first contact portion extending substantially parallel to a longitudinal axis of the door retaining bar and at least one ramp-shaped second contact portion extending obliquely to the longitudinal axis of the door retaining bar, and at least one retaining body pretensioned in the direction of the door retaining bar by a spring element and guided in the housing;

wherein the retaining body comprises at least two contact elements, by longitudinal displacement of the door retaining bar the first contact element thereof being able to be brought into an operative connection with the first contact portion and the second contact element thereof being able to be brought into an operative connection with the second contact portion, wherein the contact elements have different coefficients of friction relative to the operative connection with the contact surface of the door retaining bar; and wherein at least one contact element is configured as a rolling bearing or rolling body which is rotatably mounted on the retaining body.

2. The door arrester as claimed in claim 1, wherein the second contact element which is able to be brought into an operative connection with the second contact portion has a substantially lower coefficient of friction than the first contact element which is able to be brought into an operative connection with the first contact portion.

3. The door arrester as claimed in claim 1, wherein the contact elements are formed from different materials, wherein the materials have different coefficients of friction relative to the operative connection with the contact surface of the door retaining bar.

4. The door arrester as claimed in claim 1, wherein at least one contact element is configured as a frictional surface.

5. A motor vehicle door arrester comprising:

a retaining part comprising a housing;

a door retaining bar passing through an opening in the housing comprising a contact surface having at least one first contact portion and at least one ramp-shaped second contact portion; and a retaining body pretensioned by a spring and comprising at least two contact elements having different coefficients of friction relative to an operative connection with the contact surface, wherein at least one of the contact elements is configured as a rolling bearing or rolling body which is rotatably mounted on the retaining body.

6. The door arrester of claim 5, wherein the door retaining bar is pivotally fastened to a door or door pillar.

7. The door arrester of claim 5, wherein the at least one first contact portion extends substantially parallel to a longitudinal axis of the door retaining bar and the at least one ramp-shaped second contact portion extends obliquely to the longitudinal axis of the door retaining bar.

8. The door arrester of claim 5, wherein the retaining body is pretensioned in a direction of the door retaining bar by the spring and guided in the housing.

9. The door arrester as claimed in claim 5, wherein a second contact element which is able to be brought into an operative connection with the at least one second contact portion has a substantially lower coefficient of friction than a first contact element which is able to be brought into an operative connection with the at least one first contact portion.

10. The door arrester as claimed in claim 5, wherein the contact elements are formed from different materials, wherein the materials have different coefficients of friction relative to the operative connection with the contact surface of the door retaining bar.

11. The door arrester as claimed in claim 5, wherein at least one of the contact elements is configured as a frictional surface.

12. A motor vehicle door arrester comprising:

a retaining part comprising a housing;

a door retaining bar passing through an opening in the housing comprising first and second contact surfaces; and a retaining body pretensioned by a spring and comprising first and second contact elements having different coefficients of friction relative to an operative connection with the first and second contact surfaces; wherein the second contact element is configured as a rolling body.

13. The door arrester as claimed in claim 12, wherein the first contact surface extends substantially parallel to a longitudinal axis of the door retaining bar and the second contact surface extends obliquely to the longitudinal axis of the door retaining bar.

* * * * *